United States Patent [19]

Fox

[11] 4,284,435

[45] Aug. 18, 1981

[54] METHOD FOR SPRAY CLEANING PAINTED SURFACES

[75] Inventor: Derek J. Fox, Racine, Wis.

[73] Assignee: S. C. Johnson & Son, Inc., Racine, Wis.

[21] Appl. No.: 98,156

[22] Filed: Nov. 28, 1979

[51] Int. Cl.[3] ..... B08B 3/08

[52] U.S. Cl. ..... 134/2; 134/26; 134/29

[58] Field of Search ..... 134/2, 26, 29; 252/156, 252/527, 528, 546, 547, DIG. 11

[56] References Cited

U.S. PATENT DOCUMENTS

| | | | |
|---|---|---|---|
| 2,759,975 | 8/1956 | Chiddix et al. | 252/547 X |
| 3,714,074 | 1/1973 | Inamorato | 252/547 X |
| 3,812,046 | 5/1974 | Lancz | 252/547 X |
| 3,862,045 | 1/1975 | Sato et al. | 252/547 X |
| 3,959,157 | 5/1976 | Inamorato | 252/547 X |
| 4,093,566 | 6/1978 | MacNamara et al. | 252/527 |
| 4,102,825 | 7/1978 | Murata et al. | 252/547 |
| 4,138,371 | 2/1979 | Verdiccio et al. | 252/547 X |

*Primary Examiner*—Marc L. Caroff

[57] ABSTRACT

A cleaning composition and method for removing road film from transportation vehicles without the necessity of mechanical brushing or wiping of the surface using high pressure spray equipment. The composition comprises 2 to 30% by weight of chelating agent; 1 to 12% by weight of a bis(ethoxylated) quaternary ammonium compound; 0.5% to 5% by weight ethoxylated alcohol nonionic; 0–5% by weight sodium metasilicate and water. This concentrate is diluted with water and applied to the surface at a pressure of above 400 psi.

7 Claims, No Drawings

METHOD FOR SPRAY CLEANING PAINTED SURFACES

BACKGROUND OF THE INVENTION

This invention relates to a composition suitable for use in high pressure water jet equipment to remove traffic film and dirt from painted vehicles such as trucks, buses, railway trains and the like without the assistance of mechanical action. This invention relates to a cleaning composition particularly adapted for use in spray pressure cleaning of transportation vehicles.

Many companies believe it is important, from a corporate image viewpoint, to keep their cars, trucks, buses, etc. clean. Many of the above are painted with logos or other indicia of the owner. Traffic or road film builds up on these painted vehicles and requires some mechanical action, such as brushing or wiping with a detergent solution, to remove this film. While this is not difficult for small vehicles such as autos, it is difficult, time consuming and expensive for large vehicles such as truck trailers, railway cars and the like. There are mechanical truck washers and the like but these are expensive for an individual business to operate and maintain.

As noted above, some mechanical action was thought to be required to remove traffic film. Prior attempts to use high pressure water jet washers have not been completely successful. In fact, if too high a pressure is used, the pressure can damage the surface without removing the traffic film. Prior cleaners remove some dirt but the traffic film was not completely removed.

U.S. Pat. No. 4,093,566 describes a phosphate-free spray cleaner for metals utilizing sodium metasilicates, sodium carbonate and EDTA dissolved in water with an ethoxylated wetting agent.

U.S. Pat. No. 4,153,571 describes a heat dependent alkali gel cleaning composition based on alkali metal hydroxides and various nonionic surfactants. Also, U.S. Pat. No. 4,099,985 describes the combination of sodium metasilicate, alkali metal hydroxide and non-ionic surfactants in an aqueous system for cleaning metal surfaces.

BRIEF DESCRIPTION OF THE INVENTION AND OBJECTS AND ADVANTAGES

It has been surprisingly found that a cleaner which can remove traffic film using water jet spray apparatus can be prepared using from about 2–30% by weight of a chelating agent, from about 1–12% by weight of a bis(ethoxylated) quaternary ammonium compound, from about 0.5–5% by weight of an ethoxylated alcohol, nonionic surfactant, from about 0–5% sodium metasilicate, with the balance of the composition comprising water.

The above composition is designed to be diluted with water. The ratio of concentrate to water is within the range of from about 1:100 to 1:10.

It is therefore the object of the present invention to provide an efficient cleaning composition especially adapted to remove road film from transportation vehicle surfaces.

It is the further object of the present invention to provide a composition which can be diluted in either cold or warm water to clean vehicle bodies.

It is the still further object of the invention to provide a composition which can clean vehicle bodies using pressure spray alone without the need for mechanical brushing or scrubbing.

It is a still further object of the present invention to provide an extremely effective cleaning composition for vehicle bodies which requires a small percentage of active ingredients.

It is a still further object to provide a cleaner which effectively removes traffic film but does not damage painted surfaces.

Still further objects and advantages of the composition of the present invention will become more apparent from the following, more detailed description thereof.

DETAILED DESCRIPTION OF THE INVENTION

The composition of the present invention comprises from about 2–30% by weight of a chelating agent, from about 1–12% by weight of a bis(ethoxylated) quaternary ammonium compound, from about 0.5–5% by weight of an ethoxylated alcohol, nonionic surfactant, from about 0–5% by weight of sodium metasilicate, with the balance of the composition comprising water.

The first critical component of the composition of the present invention is the bis(ethoxylated) quaternary ammonium compound. It is this material which, in combination with the chelating agent, provides the unique ability for the transportion cleaner of the present invention to remove traffic film quickly and efficiently without mechanical agitation. It is theorized that traffic film comprises a number of components, including carbon black, dirt, hydrocarbon materials, and the like. Carbon black, dirt and dust particles can often contain a positive charge. It is thought that the high adherency of road film to painted vehicle bodies results from this charge phenomena, rather than the formation of a continuous film over the entire vehicle body. The use of bis(ethoxylated) quaternary ammonium compounds counteracts the charge character of these small discreet particles and allows the same to be easily and efficiently removed without mechanical action.

Suitable bis(ethoxylated) ammonium quaternary compounds include compounds having the following formula $$\left[ H-(OCH_2CH_2)_x-\overset{\overset{R}{|}}{\underset{\underset{R_1}{|}}{N}}-(CH_2CH_2O)_y-H \right]^+ A^-$$

wherein R is methyl, ethyl or propyl, $R_1$ is an alkyl group having from 8 to 18 carbon atoms, an alkenyl group having 8 to 18 carbon atoms or mixtures thereof, x is a number from 1 to 40, y is a number from 1 to 40, wherein x+y is between 10 to 60, and A is a water soluble anion. Preferred bis(ethoxylated) quaternary ammonium compounds include the following:

stearyl methyl bis(ethoxy) ammonium chloride (12 moles EO), stearyl ethyl bis(ethoxy) ammonium ethyl sulfate (15 moles EO), tallow methyl bis(ethoxy) ammonium methyl sulfate (15 moles EO), tallow ethyl bis(ethoxy) ammonium ethyl sulfate (15 moles EO), hydrogenated tallow methyl bis(ethoxy) ammonium chloride (15 moles EO), coco methyl bis(ethoxy) ammonium methyl sulfate (20 moles EO). The most preferred ammonium compounds are the tallow methyl bis(ethoxy) ammonium methyl sulfate (15 moles EO) and the tallow ethyl bis(ethoxy) ammonium ethyl sulfate (15 moles EO). Also mixtures of these compounds can be used. In the above description the amount of ethoxylation is total ethoxylation for the molecule i.e. tallow methyl bis(ethoxy) ammonium methyl sulfate (15 moles EO) contains 15 moles of ethylene oxide. The values for individual x and y are not critical, however, the combined total is critical as this effects the HLB of these compounds. Preferably the ammonium compounds useful in the present invention have an HLB of from about 14.0 to 22.0 and are hydrophilic.

The bis(ethoxylated) quaternary ammonium compound should be present in the composition of the present invention in amount of from about 1 to 12% by weight on the total weight of the concentrate composition. It is preferred that the concentrate contain from about 1 to 6% by weight quaternary compound. As this composition is designed to be diluted in an aqueous system at dilutions of from 1 part concentrate to 100 part water to 1 part concentrate to 10 parts of water, the final concentration of the quaternary ammonium compound in the final use solution, can vary substantially. However, it has been found that at the final use concentration from about 0.01 to 1.2% bis(ethoxylated) quaternary ammonium compound is necessary in order to remove traffic film from painted transportation vehicles. It is preferred to have a final use concentration of from about 0.04 to 0.2% by weight and optionally to have from about 0.06 to 0.1% by weight quaternary compound.

The second critical component of the composition of the present invention is a chelating agent which chemically softens the feed water, binds insoluble metal ions present in the traffic film, and also increases surfactant activity and reduces the redeposition of the soil. These chelating agents should be present in amounts of from about 2 to 30% by weight based on the weight of the concentrate, and preferably from about 3 to 15% by weight.

Sufficient chelating agent must be present in the concentrate so that when the concentrate is diluted to final use strength, the diluted composition will contain from about 0.02 to 3% by weight and preferably from about 0.1 to 1% by weight chelating agent.

Suitable chelating agents include: trisodium nitrilotriacetate, trisodium hydroxyethyl ethylene diamine tetraacetate, tetrasodium ethylene diamine tetraacetate, sodium salt of diethanol glycine, the sodium salt of polyacrylic acid, and the like. Mixtures of the above can also be used. The preferred chelating agent is trisodium nitrilotreacetate.

The composition of the present invention also includes an ethoxylated linear or secondary alcohol having from 8 to 18 carbon atoms reacted with from 2 to 12 moles of ethylene oxide. It is preferred that the nonionic have from 3 to 8 moles of ethylene oxide, with the optimum being about 6 moles. These nonionic surfactants are wetting agents which allow the quaternary compound to disrupt the adherent traffic film. However, these surfactants are difficultly soluble in the concentrate. Therefore the minimum amount which will provide the proper wetting characteristics is preferred. When the degree of ethoxylation is high the product is more stable in the system, however the composition does not clean as effectively as those having a lower degree of ethoxylation, which are less stable. With nonionics having a lower degree of ethoxylation, it is necessary to balance this surfactant with the quaternary to obtain proper solubility of the nonionic in the composition.

These materials are commercially available and well-known nonionic surfactants. The following materials are particularly preferred: lauryl alcohol ethoxylated with 3 moles of ethylene oxide (EO), coco alcohol ethoxylated with 3 moles EO, stearyl alcohol ethoxylated with 5 moles EO, mixed $C_{12}$–$C_{15}$ alcohol ethoxylated with 7 moles EO, mixed secondary $C_{11}$–$C_{15}$ alcohol ethoxylated with 7 moles EO, mixed $C_9$–$C_{11}$ linear alcohol ethoxylated with 6 moles EO and the like. Further, it has been found that the length of the alkyl chains is more important in the present invention than the degree of ethoxylation. It is preferred that the nonionic have from 8 to 12 carbon atoms in the alkyl group. When this preferred alkyl group is used the most preferred nonionic is the mixed $C_9$–$C_{11}$ alcohol ethoxylated with 6 moles EO. The nonionic surfactant is present in the concentrate of the present invention in an amount of from about 0.5 to 5% by weight and preferably from 0.8 to 3% by weight. The amount of nonionic in the final use concentration is from about 0.005 to 0.5% by weight and preferably 0.01 to 0.3% by weight.

The composition of the present invention can preferably include sodium metasilicate which is an alkaline builder, soil dispersant, buffering agent, and the like. This optional material can be present in amounts of from 0 to 5% in the concentrate composition and preferably from about 0.5 to 3% by weight. The amount of sodium metasilicate present in the final use concentration is from about 0 to 0.5% by weight and preferably from 0.005 to 0.3% by weight. The builder should be present in an amount sufficient to provide a pH within the range of from 11.5 to 13.0 and preferably from 12.0 to 13.0. Within this range cleaning is enhanced while at the same time damage to the painted surface is minimized. When the composition is diluted, the dilution should have a pH within the range of 10.5 to 12.0 and preferably 11.0 to 11.5.

The concentrate of the present invention is an aqueous composition. The balance of the composition is essentially water. No particular provisions with regard to non-deionized or distilled water is required.

The composition of the present invention is useful in cleaning transportation vehicles by pressure spraying with a water concentrate mixture having a temperature of as low as 1° C., although higher temperature water up to 95° C. can be utilized. Generally, it has been found that water having a temperature of from 5° to 40° C. is preferred, with water having a temperature of from 5° to 30° C. being most preferred. It is within these preferable ranges that cleaning is optimized and damage to the painted surfaces is minimized. Further this results in an energy savings as hot water need not be utilized to clean the vehicles.

The composition in the present invention can be either pre-diluted before being introduced to the pressure spray apparatus, or can be mixed in situ during spraying. Generally from 1 part concentrate mixed with 100 to 10 parts water will provide effective cleaning. The exact amount depends on the water hardness, the type of soil in the traffic film, the concentration of actives in the concentrate and the like, i.e. with harder water, a more concentrated solution must be used. Also with soils containing particular metals, a higher concentration is desirable for most effective cleaning. Nevertheless, satisfactory results can be obtained using dilutions within the above range although 1:50 to 1:10 is most preferred.

The compositions of the present invention are sprayed onto the surface to be cleaned using pressure spray apparatus capable of delivering the diluted product at a nozzle pressure of above 400 psi and preferably from 450 psi to 1000 psi. The product is allowed to remain in contact with the surface for a short period of time, generally less than 10 minutes, and then should be rinsed, with water, using a low or high pressure spray preferably using a high pressure spray having a pressure of about 450 psi and preferably above 450 psi.

The composition of present invention will now be illustrated by the following examples wherein all parts and percentages are by weight, and all temperatures and degrees are in Celsius.

EXAMPLES 1 AND 2

The following two formulations were prepared by mixing the components into the water at 20°:

| | Example 1 | Example 2 |
|---|---|---|
| Sodium metasilicate, anhydrous | 1.0 | 1.0 |
| NTA, $Na_3$ (40%) | 11.8 | 11.8 |
| Neodol 91-6[1] | 1.25 | 1.25 |
| Water | 83.95 | 83.95 |
| Coco bis(ethoxy) methyl ammonium chloride (15 moles EO) | 2.0 | — |
| $C_{14}$ alkyl bis(ethoxy) methyl ammonium chloride (15 moles EO) | — | 2.0 |

[1]Neodol 91-6 - $C_9$ to $C_{11}$ alkyl plus 6 moles ethylene oxide nonionic surfactant.

Each of the above forms a clear solution at 20° C. and has a cloud point of above 50° C. with a pH of 12.8.

The above compositions were applied as 1:20 dilutions with high pressure to a painted truck trailer. The composition was allowed to stand in contact with the soil for from 1 to 2 minutes and then removed using a high pressure rinse. Each composition removed 80 to 90% of the dirt and traffic film.

EXAMPLES 3 AND 4 AND COMPARATIVE EXAMPLES 1 TO 4

The compositions as shown in Table I were prepared using the procedure of Example 1. Each composition was diluted 1:25 and applied to a yellow Ford Custom Pick-Up Truck using high pressure spray apparatus, 500 psi average. The cleaning results are shown in Table I.

TABLE I

| | EXAMPLE | | | | | |
|---|---|---|---|---|---|---|
| | 3 | 4 | Comp 1 | Comp 2 | Comp 3 | Comp 4 |
| NTA, $Na_3$ (40%) | 11.8 | 11.8 | 11.8 | — | 10.0 | 11.8 |
| Sodium Metasilicate Anhydrous | — | 1.0 | 1.0 | 1.0 | — | 1.0 |
| Neodol 91-6[1] | 1.25 | 1.25 | 1.25 | 1.25 | 1.2 | — |
| Berol 563[2] | 2.0 | 2.0 | — | 2.0 | 2.0 | 2.0 |
| NTA acid | — | — | — | — | 0.7 | — |
| Water | 84.95 | 83.95 | 85.95 | 95.75 | 86.1 | 85.2 |
| Appearance at 2% | Clear | Clear | Clear | Hazy | Clear | Clear |
| pH of Concentrate | 12.8 | 12.8 | 12.8 | 12.5 | 9.5 | 12.8 |
| Cleaning 5 = 100% Cleaning 1 = Water Only | 4.5-5 | 5 | 3.5 | 2.5 | 3.5-4.5 | 3.5-4 |

[1]Neodol 91-6 - See Example 1
[2]Berol 563 - Alkyl bis(ethoxy) methyl ammonium methyl sulfate (15EO)

In comparing the relative cleaning scores, it is apparent that chelating agent, quaternary surfactant and a proper pH are required to effective removal of road film. Comparatives 1 and 2, which did not contain a quaternary or chelating agent, were inferior to Examples 3 and 4. Comparative 3, which had a lower pH, shows some reduction in cleaning as does comparative 4, which did not contain surfactant.

EXAMPLE 5

The following formulation was prepared:

| | |
|---|---|
| Sodium metasilicate, anhydrous | 1.0 |
| polyacrylic acid (25%) | 17.5 |
| Berol 563[1] | 2.0 |
| Neodol 91-6[2] | 1.25 |
| NaOH | 3.0 |
| Water | 74.75 |
| pH = | 12.5 |

[1]Berol 563 - See Example 3
[2]Neodol 91-6 - See Example 1

The NaOH in the composition is to neutralize the polyacrylic acid. The formulation was diluted 1:25 and used to clean the cab of a dump truck and a yellow pickup using high pressure spray apparatus, 500 psi average. In both instances substantially all the dirt and traffic film was removed.

EXAMPLES 6-9

The formulas shown in Table II were prepared and tested as 1:25 dilutions on a yellow pickup, a yellow dump truck cab and Example 8 was tested on two school buses and on three white painted aluminum trailers using high pressure spray apparatus, 500 psi average.

TABLE II

| | EXAMPLE | | | |
|---|---|---|---|---|
| | 6 | 7 | 8 | 9 |
| Sodium metasilicate, anhydrous | 1.0 | 1.0 | 1.0 | 1.0 |
| NTA, $Na_3$ (40%) | 11.8 | 11.8 | 11.8 | 11.8 |
| Q-18-15[1] | 2.0 | — | — | — |
| Q-14-15[2] | — | 2.0 | — | — |
| Q-18-25[5] | — | — | — | 2.0 |
| Varstat 66[3] | — | — | 2.00 | — |
| Neodol 91-6[4] | 1.25 | 1.25 | 1.25 | 1.25 |
| Water | 83.95 | 83.95 | 83.95 | 83.95 |
| pH of Concentrate | 12.8 | 12.8 | 12.8 | 12.8 |
| Performance 1 = water only 5 = 100% clean | | | | |
| Yellow pickup | 5 | 4-5 | 5 | — |
| Yellow dump truck | 5 | 4-5 | 5 | 5 |
| School bus 1 | — | — | 5 | — |
| School bus 2 | — | — | 5 | — |
| White trailer 1 | — | — | 5 | — |
| White trailer 2 | — | — | 5 | — |

TABLE II-continued

| | EXAMPLE | | | |
|---|---|---|---|---|
| | 6 | 7 | 8 | 9 |
| White trailer 3 | — | — | 5 | — |

[1]Q-18-15 C18 alkyl bis(ethoxy) methyl ammonium methyl sulfate (15 moles EO)
[2]Q-14-15 C14 alkyl bis(ethoxy) methyl ammonium methyl sulfate (15 moles EO)
[3]Varstat 66 Tallow bis(ethoxy) ethyl ammonium ethyl sulfate (15 moles EO)
[4]Neodol 91-6 See Example 1
[5]Q-18-25-C18 alkyl bis(ethoxy) methyl ammonium methyl sulfate (25 moles EO)

The above data shows that varying quaternaries can be used as long as they are bis(ethoxylated) with the proper degree of ethoxylation.

EXAMPLES 10-11

The following formulations varying the chelating agent were prepared as shown in Table III. The compositions were tested at varying use dilutions using high pressure spray apparatus, 500 psi average.

TABLE III

| | EXAMPLE | |
|---|---|---|
| | 10 | 11 |
| HEEDTA, $Na_3$ (41.3%)[1] | 23.0 | — |
| DEG, Na (40%)[2] | — | 10.0 |
| Neodol 91-6[3] | 2.5 | 2.5 |
| Berol 563[4] | 4.0 | 4.0 |
| Water | 68.5 | 68.5 |
| Sodium metasilicate, anhydrous | 2.0 | 2.0 |
| NTA, $Na_3$ (40%) | — | 13.0 |
| Performance 1 = water 5 = complete removal | | |
| | 5 at 1:20 | 4 at 1:20 |
| | 4-5 at 1:40 | 3 at 1:40 |
| | 3 at 1:80 | 2.5 at 1:80 |

[1]HEEDTA, $Na_3$ - Trisodium hydroxylethyl ethylene diamine tetra acetate
[2]DEG, Na - Sodium salt of diethanol glycine
[3]Neodol 91-6 - See Example 1
[4]Berol 563 - See Example 3

These Examples show the effectiveness of other chelating agents and mixtures of chelating agents in compositions of the present invention.

EXAMPLE 12

The following formulation was prepared:

| | |
|---|---|
| Tetrasodium ethylene diamine tetra acetate (38%) | 36.8 |
| Ethylan CD 916[1] | 2.5 |
| Berol 563[2] | 4.0 |
| Sodium metasilicate anhydrous | 2.0 |
| Water | 54.7 |

[1]Ethylan CD 916 - $C_9$ to $C_{11}$ alkyl plus 6 moles of ethylene oxide nonionic surfactant.
[2]Berol 563 - See Example 3

The above formula had a pH of 12.8 and a cloud point of 50° C. This formula was tested as a 1 to 40 dilution using high pressure spray apparatus, 500 psi average, and substantially removed all traffic film and dirt.

I claim:

1. A method of cleaning large painted surfaces without damaging the paint comprising spraying the surface at a pressure of 400 to 1000 psi with an aqueous composition comprising 0.02 to 3% by weight of a chelating agent, from about 0.01 to 1.2% of a bis(ethoxylated) quaternary ammonium compound having a degree of ethoxylation of from 10 to 60 moles of ethylene oxide, from 0.005 to 0.5% of an ethoxylated alcohol, nonionic surfactant, from 0 to 0.5% by weight sodium metasilicate and the balance comprising water.

2. The method of claim 1 wherein the bis(ethoxylated) quaternary ammonium compound has the following formula:

$$\left[ H-(OCH_2CH_2)_x-\overset{\overset{R}{|}}{\underset{\underset{R_1}{|}}{N}}+(CH_2CH_2O)_y-H \right]^+ A^-$$

wherein R is methyl ethyl or propyl, $R_1$ is an alkyl group having from 8 to 18 carbon atoms, an alkenyl group having from 8 to 18 carbon atoms or mixtures thereof, x is a number from 1 to 40, y is a number from 1 to 40 with the provision that x+y is between 10 to 60 and A is a water soluble anion.

3. The method of claim 2 wherein the quaternary ammonium compound is selected from the group consisting of tallow methyl bis(ethoxy) ammonium methyl sulfate (15 moles EO), tallow ethyl bis(ethoxy) ammonium ethyl sulfate (15 moles EO) and mixtures thereof.

4. The method of claim 1 wherein the chelating agent is selected from the group consisting of trisodium nitrilotriacetate, trisodium hydroxyethyl ethylene diamine tetraacetate, tetrasodium ethylene diamine tetraacetate, the sodium salt of diethanol glycine, the sodium salt of polyacrylic acid and mixtures thereof.

5. The method of claim 1 wherein the ethoxylated linear alcohol has from 8 to 18 carbon atoms in the alkyl group and from 2 to 12 ethylene oxide groups.

6. The method of claim 1 wherein the composition comprises from about 0.1 to 1% by weight chelating agent; from about 0.04 to 0.2% by weight quaternary ammonium compound; from about 0.01 to 0.3% by weight nonionic surfactant; from about 0.005 to 0.3% by weight metasilicate.

7. A method of cleaning large painted surfaces which comprises (a) mixing a concentrate having a composition comprising from about 2-30% by weight of a chelating agent, from about 1 to 8% by weight of a bis(ethoxylated) quaternary ammonium compound having a degree of ethoxylation of from 10 to 60 moles ethylene oxide, from about 0.5-5% by weight of an ethoxylated alcohol, nonionic surfactant, from 0-5% by weight of sodium metasilicate and the balance comprising water, with water in a ratio of concentrate to water of 1:10 to 1:100;

(b) spraying the mixture onto the surface to be cleaned at a pressure of above 400 psi;

(c) rinsing the surface with water at a pressure of above 400 psi.

* * * * *